US010156221B2

(12) United States Patent
Skowronek et al.

(10) Patent No.: US 10,156,221 B2
(45) Date of Patent: Dec. 18, 2018

(54) IGNITION SYSTEM AND METHOD FOR CHECKING ELECTRODES OF A SPARK PLUG OF AN INTERNAL COMBUSTION ENGINE

(71) Applicant: Robert Bosch GmbH, Stuttgart (DE)

(72) Inventors: Tim Skowronek, Missen-Wilhams (DE); Thomas Pawlak, Immenstadt (DE); Wolfgang Sinz, Hergatz (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/514,016

(22) PCT Filed: Aug. 3, 2015

(86) PCT No.: PCT/EP2015/067817
§ 371 (c)(1),
(2) Date: Mar. 24, 2017

(87) PCT Pub. No.: WO2016/050388
PCT Pub. Date: Apr. 7, 2016

(65) Prior Publication Data

US 2017/0284358 A1 Oct. 5, 2017

(30) Foreign Application Priority Data

Sep. 29, 2014 (DE) ..... 10 2014 219 722

(51) Int. Cl.
*F02P 17/00* (2006.01)
*F02P 17/12* (2006.01)
(Continued)

(52) U.S. Cl.
CPC ..... *F02P 17/12* (2013.01); *F02P 9/002* (2013.01); *F02P 9/007* (2013.01); *F02D 41/009* (2013.01);
(Continued)

(58) Field of Classification Search
CPC .. F02P 17/00; F02P 17/12; F02P 17/22; F02P 9/00
(Continued)

(56) References Cited

U.S. PATENT DOCUMENTS 4,825,167 A * 4/1989 Bayba ..... F02P 11/06 324/399
5,491,416 A * 2/1996 Klimstra ..... F02P 17/12 324/393
(Continued)

FOREIGN PATENT DOCUMENTS

CN 102678424 A 9/2012
DE 102007029953 A1 1/2009
(Continued)

OTHER PUBLICATIONS

International Search Report dated Oct. 14, 2015 of the corresponding International Application PCT/EP2015/067817 filed Aug. 3, 2015.

*Primary Examiner* — Neel Shah
(74) *Attorney, Agent, or Firm* — Norton Rose Fulbright US LLP; Gerard Messina

(57) ABSTRACT

A method for checking electrodes of a spark gap of an ignition system for a combustion chamber of an internal combustion engine with an externally provided ignition includes generating a spark at the spark gap in an operating state without ignition of an ignitable mixture in the combustion chamber; ascertaining a parameter or characteristic function representing the spark current, the spark voltage, and/or the spark duration; comparing the parameter or the characteristic function to a reference; adapting an energy for a voltage buildup for a further spark generation for the mixture ignition and/or for maintaining an ignition spark for the mixture ignition, in particular for a future ignition
(Continued)

process, as a function of a difference between the parameter or the characteristic function and the reference.

25 Claims, 2 Drawing Sheets

(51) Int. Cl.

| | |
|---|---|
| ***F02P 9/00*** | (2006.01) |
| *F02D 41/00* | (2006.01) |
| *F02P 15/10* | (2006.01) |
| *H01T 13/60* | (2011.01) |
| *F02P 3/04* | (2006.01) |
| *F02P 3/08* | (2006.01) |
| *H01T 15/00* | (2006.01) |

(52) U.S. Cl.
CPC ..... *F02P 3/0407* (2013.01); *F02P 3/0876* (2013.01); *F02P 15/10* (2013.01); *F02P 2017/121* (2013.01); *F02P 2017/123* (2013.01); *H01T 13/60* (2013.01); *H01T 15/00* (2013.01)

(58) Field of Classification Search
USPC ..... 324/384, 385, 393, 398, 399, 402
See application file for complete search history.

(56) References Cited

U.S. PATENT DOCUMENTS

| | | | | |
|---|---|---|---|---|
| 6,236,213 | B1 * | 5/2001 | Maruta | F02P 17/12 324/393 |
| 6,426,626 | B1 * | 7/2002 | Kravis | F02P 3/02 324/388 |
| 7,212,005 | B2 * | 5/2007 | Bumen | F23Q 23/10 324/378 |
| 2004/0000878 | A1 | 1/2004 | Petruska et al. | |

FOREIGN PATENT DOCUMENTS

| | | | |
|---|---|---|---|
| DE | 102011115735 | A1 | 5/2012 |
| DE | 102011005651 | A1 | 9/2012 |
| DE | 102012208532 | A1 | 11/2013 |
| DE | 102013218227 | A1 | 5/2014 |
| EP | 1835172 | A2 | 9/2007 |
| GB | 717676 | A | 11/1954 |
| WO | 9304279 | A1 | 3/1993 |
| WO | 2009106100 | A1 | 9/2009 |
| WO | 2014041070 | A1 | 3/2014 |

* cited by examiner

IGNITION SYSTEM AND METHOD FOR CHECKING ELECTRODES OF A SPARK PLUG OF AN INTERNAL COMBUSTION ENGINE

CROSS-REFERENCE TO RELATED APPLICATIONS

The present application is the national stage of International Pat. App. No. PCT/EP2015/067817 filed Aug. 3, 2015, and claims priority under 35 U.S.C. § 119 to DE 10 2014 219 722.8, filed in the Federal Republic of Germany on Sep. 29, 2014.

FIELD OF THE INVENTION

The present invention relates to an ignition system for an internal combustion engine and to a method for checking electrodes of a spark gap of an ignition system for a combustion chamber of an internal combustion engine with an externally supplied ignition. In particular, the present invention relates to checking the electrodes while the internal combustion engine is in operation. More specifically, the present invention relates to an ignition system for internal combustion engines on which greater demands are placed on account of (high pressure) supercharging and diluted, difficult to ignite mixtures ($\lambda >> 1$, lean-stratified charge concepts, high EGR rates).

BACKGROUND

GB 717676 shows a step-up transformer for an ignition system, in which a circuit part, controlled via a vibration switch, of the type of a step-up converter is used in order to supply electrical energy to a spark generated via the step-up transformer.

WO 2009/106100 A1 shows a circuit configuration structured according to a high-voltage capacitor ignition system, in which energy stored in a capacitor is forwarded to the primary side of a transformer on the one hand, and via a bypass having a diode to a spark gap on the other.

US 2004/000878 A1 shows an ignition system in which an accumulator on the secondary side, which includes a plurality of capacitors, is charged in order to supply electrical energy to a spark generated with the aid of a transformer.

WO 9304279 A1 shows an ignition system having two energy sources. one energy source transmits electrical energy via a transformer to a spark gap, while the second energy source is situated between a secondary-side terminal of the transformer and the electrical ground.

DE 10 2013 218 227 A1 describes an ignition system in which a high-voltage generator generates an ignition spark, which is then supplied with electrical energy and maintained by a step-up chopper.

SUMMARY

Because of spark erosion, the electrodes of the spark gap are exposed to stresses that may lead to malfunctions and finally to the failure of the ignition system. The electrode gap is able to be checked by uninstalling the spark plugs and measuring the electrode gap, for example. However, malfunctions that arise during the operation are unable to be allocated unequivocally. Especially an initiation of measures during the ongoing operation in order to remedy errors is not possible. For example, it would be desirable to ascertain the wear state in the form of an onboard diagnosis (OBD) so that a demand-oriented voltage availability at the voltage generator and a demand-oriented supply of a suitable spark energy are able to be carried out. The reason for this is that with a spark plug in new condition, the demand for the voltage generation and the spark energy are low, but it increases once the wear limit of the spark plug has been reached. This would offer the advantage of reducing the energy expenditure with a new spark plug, of reducing the power loss, and of preventing heating of the ignition system as well as thermal and electrical aging and erosion of the spark plug. Therefore, it is an object of the present invention to satisfy the demand identified above.

According to example embodiments of the present invention, the object identified above is achieved by a method for checking electrodes of a spark gap of an ignition system for a combustion chamber of an internal combustion engine having externally supplied ignition. In a first step, a spark is generated at the spark gap in an operating state in which no ignitable mixture is ignited in the combustion chamber. For this purpose, the spark may especially be generated in a working stroke of the internal combustion engine in which no ignitable mixture is present in the combustion chamber. In a second step, an ascertainment of a parameter representing the spark current and/or the spark voltage and/or the spark duration takes place. The parameter may also be a characteristic function ascertained over the time. In this case, the time profile of the parameter over the time is characterized and evaluated. The parameter or the characteristic function is subsequently compared with a predefined reference. The reference, for instance, may characterize setpoint values for the parameter or setpoint curves of the characteristic function.

For example, ranges for the spark current, the spark voltage and/or the spark duration that the parameter or the characteristic function must not enter are able to be defined by the reference. For instance, a spark current that is too low, a spark voltage that is too high or an insufficient spark duration is problematic for a reliable mixture ignition in the combustion chamber. The present invention enables a check of the electrodes during the operation and an immediate initiation of possibly required measures. For example, one possible measure may consist of adapting an energy for the voltage buildup for a spark generation and/or for maintaining an ignition spark for the mixture ignition. This may take place in particular as a function of a difference between the parameter or the characteristic function and the reference. The adaptation of the energy may be carried out for a current or a future ignition process. In this way energy that is adequate for the mixture ignition is used, thereby realizing a reliable mixture ignition at an electrically high efficiency of the ignition system.

The reference may be developed as a first threshold value, which is specified on the basis of the electrode gap during the initial operation of the ignition system (at the factory, for example) and takes a maximally permissible wear into account. Of course, it is also possible to provide multiple values as reference or a continuous allocation of a reference function and corresponding measures for adapting the supplied electrical energy. While discrete values as reference require less storage space, a continuous reference function allows for the best-possible adaptation of the operating method of the ignition system.

The spark, for example, can be generated with the aid of a primary-voltage generator and maintained in particular with the aid of a step-up chopper, preferably exclusively by the step-up chopper (according to an ignition system as described in DE 102013 218 227 A). Such a system allows for an exact control of the electrical energy output to the spark gap, knowledge of which makes it possible to evaluate the ascertained parameter very precisely in order to draw conclusions with regard to a gap of the electrodes of the spark gap and/or their state of erosion, for example.

The comparison of the parameter to the reference may include an evaluation of the threshold value, for example. If the parameter or the characteristic function drops below or increases beyond a predefined threshold value, for instance, a class for the electrode state allocated to the undershooting or overshooting of the threshold value is able to be identified, and measures possibly allocated to the class may be initiated. In case of a characteristic function ascertained over the time, in which the reference also has at least two temporally sequential values for the characteristic function, a profile of the characteristic function is able to be evaluated, classified and utilized as a prompt for an initiation of countermeasures.

A preferred instant for generating the ignition spark is a state in the combustion chamber that has a predictable or known influence on the parameter of the spark, if possible. For example, such an instant exists when the turbulence prevailing in the combustion chamber is as low as possible. In this way a current value for the parameter and/or of values for the characteristic function allows for direct conclusions with regard to the state of the electrodes. In the case of an ignition spark provided for igniting an ignitable mixture according to the related art, on the other hand, turbulence and pressure fluctuations influence said parameters within clearly broader limits so that a direct inference regarding the state of the electrodes is made more difficult.

For example, the spark may be generated in an exhaust working cycle, the intake valves of the internal combustion engine preferably being closed. For one, especially suitable conditions prevail in the combustion chamber in this power cycle, and for another, damage to the internal combustion engine due to the closed intake valves is able to be effectively prevented even in the event that ignitable mixture has remained in the combustion chamber. The use of the step-up chopper allows for the generation of an essentially static spark current and/or an essentially static electrical output. Both variables are able to be generated in the presence of suitable states in the combustion chamber by actuating the step-up chopper, in response to which the electrode state or the electrode gap is especially easy to determine as essentially the sole cause for a current value of the parameter.

In the event that a spark voltage as parameter exceeds the reference and/or a spark current as parameter undershoots the reference, the ignition system may be induced to provide a higher spark current and/or a greater voltage availability and/or a higher output power. Thus, the ignition system may be induced to provide a higher voltage availability since the voltage requirement for the spark generation becomes greater due to the larger electrode gap. In other words, the voltage-generation unit must be supplied with more energy which, for instance, may be accomplished with the aid of what is termed a boost operation of a step-up chopper (SUC) provided in the ignition system, in which a relatively low input voltage is used for generating a higher output voltage (step-up chopper operation). In addition, the ignition system may be made to supply a higher output power (and thus a higher spark current), which, for example, is able to be realized via a modified operating mode of a step-up chopper for the mixture ignition provided in the ignition system. In particular, such a measure may be initiated with regard to the output variables of a utilized step-up chopper as well as via the primary-voltage generator. Because of the increase in the electrical output supplied at the spark gap and the voltage availability increased via the primary voltage generator, a greater gap/state of erosion of the electrodes is able to be compensated within certain limits. An exchange of the electrodes is able to be postponed in this way without putting the reliability of the ignition system according to the present invention at risk.

The parameter and the characteristic function are preferably able to be ascertained in a stationary (invariable over the time) state. This may apply in particular to the electrical processes and/or the chemical processes in the combustion chamber or at the spark gap. Stationary processes allow for a precise ascertainment of the parameter or the characteristic function, which in turn makes it possible to ascertain required measures in an exact manner.

In the event that an electrical voltage is used as reference, it can be determined whether an overshooting condition is satisfied by ascertaining whether the spark voltage at the spark gap exceeds the predefined reference. As an alternative or in addition, in the event that an electrical current is used as the predefined reference, it can be determined whether an undershooting condition is satisfied by ascertaining whether the spark current or an output current of a step-up chopper used for the energy supply of the spark gap undershoots the reference. In response to the overshooting condition or the undershooting condition, an available voltage for the spark generation may be increased. As an alternative or in addition, an output power of a utilized primary voltage generator or a step-up chopper may be increased. A spark current and/or an output current of the step-up chopper, in particular, may be increased for this purpose. The operation of the ignition system according to the present invention is thereby able to be energetically optimized and yet still be carried out in a functionally reliable manner.

Using the reference, the ascertained (e.g., measured) parameter or characteristic function is able to be classified with regard to a readiness for operation of the electrodes. In response thereto, a fault signal may be output, which leads to the display of a corresponding message in a vehicle equipped with the ignition system, for example, or it leads to an entry in a fault memory, which can be read out in a service facility. In the event that a replacement of the electrodes is necessary, an exchange is able to be undertaken very quickly.

The voltage availability at the electrodes of the spark gap is able to be increased in a step-by-step manner, for instance, until a predefined second threshold value has been reached. Then, it can be checked whether the parameter and/or the characteristic function have/has reached a suitable value with regard to the reference. Here, for example, the second threshold value may characterize a maximally permitted parameter or characteristic function, beyond which an electrically reliable operating mode of the ignition system and/or an energetically meaningful operating mode of the ignition system and/or a permanent reliability of operation of the ignition system are/is no longer ensured.

Once the predefined second threshold value has been reached, a fault signal may preferably be output, which indicates the required exchange of the electrodes (e.g., of a spark plug). The fault signal is able to be stored in a fault memory, for instance, and/or be used for the optical and/or acoustic outputting of a signal to a user of the ignition system.

According to another example embodiment of the present invention, an ignition system for an internal combustion engine with externally supplied ignition is provided. The ignition system includes a spark gap, a primary-voltage generator for generating a spark at the spark gap, and an evaluation unit. The primary-voltage generator, for example, may be developed as an ignition coil or as an ignition transformer. The evaluation unit may be designed as a programmable processor, a programmable controller, an ASIC or an FPGA (Field Programmable Gate Array), for instance. As a result of the evaluation unit, which is able to evaluate the parameter and/or the characteristic function of the electrical state variables at the spark gap as well as predefined references, the ignition system according to the present invention is set up to execute a method as described in detail above. The features, feature combinations and the advantages resulting therefrom correspond to those enumerated above, so that, for the sake of brevity, reference is made to the above comments with respect to the description of the method.

In an example embodiment of the present invention, the ignition system includes a step-up chopper for maintaining a spark, whose output lies in an electrical loop with the spark gap. The step-up chopper is thereby developed to inject a predefined electrical quantity, in particular an output current and/or an output voltage and/or an output power, into the spark gap that is better controllable than by an ignition transformer. On this basis, the ascertained parameters or the ascertained characteristic function in conjunction with the predefined reference permit direct conclusions with regard to the electrodes of the spark gap. If the ignition system or its evaluation unit determines because of the result of the comparison of the parameter/characteristic function with the predefined reference a need to do so, it is able to appropriately adapt the operating method of the step-up chopper, that is to say, its electrical output variable or the voltage made available by the primary voltage generator. Thus, even an advanced wear state of the electrodes does not jeopardize the operational reliability of the ignition system according to the present invention.

Exemplary embodiments of the present invention are described in detail in the following text with reference to the attached figures.

DETAILED DESCRIPTION

Figure 1:
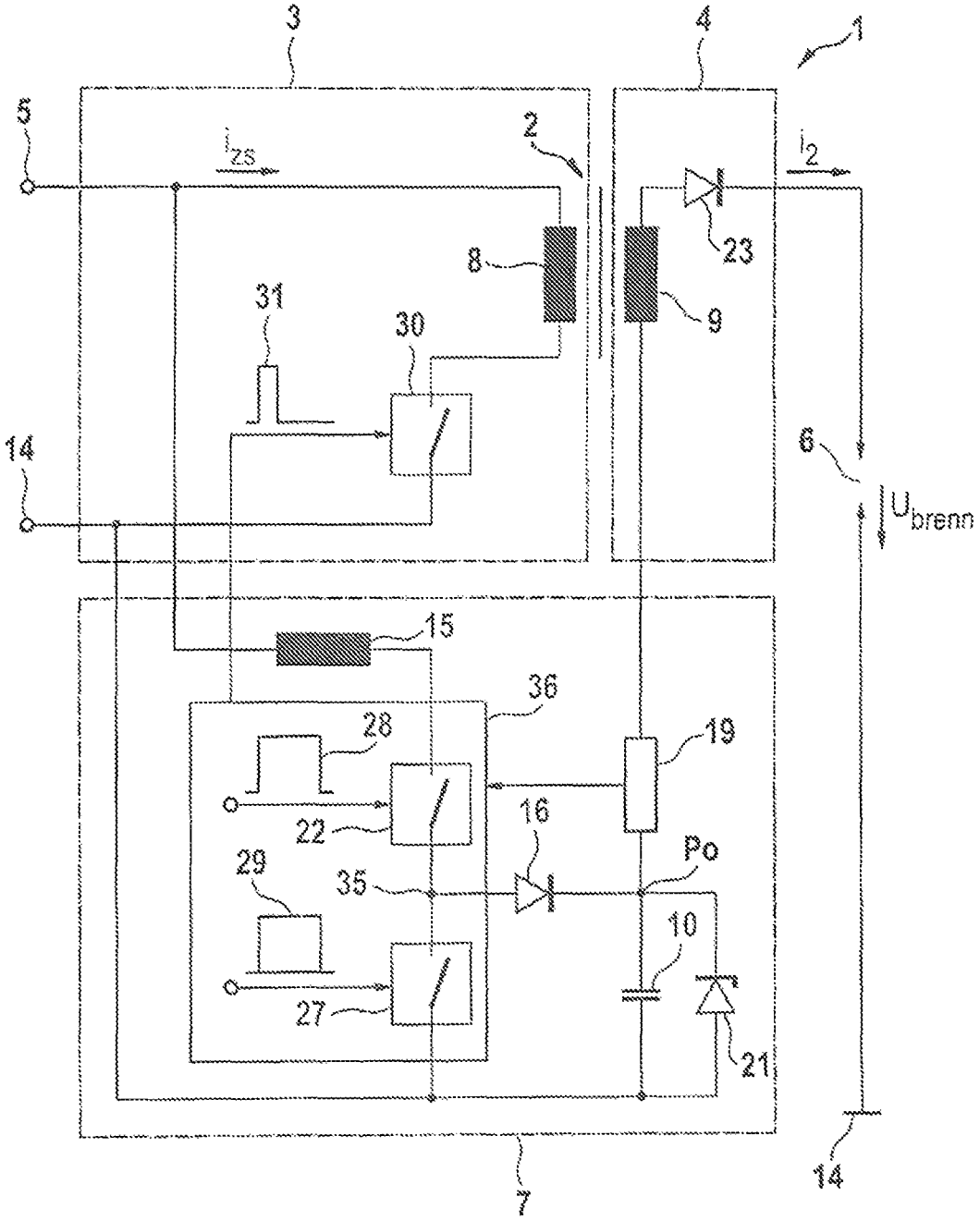
FIG. 1 a circuit diagram of an ignition system according to an example embodiment of the present invention.

FIG. 1 shows a circuit of an ignition system 1, which includes a step-up transformer 2 as a high-voltage generator, whose primary side 3 is able to be supplied with electrical energy from an electrical energy source 5 via a first switch 30. Secondary side 4 of step-up transformer 2 is supplied with electrical energy via an inductive coupling of primary coil 8 and secondary coil 9 and has a diode 23, known from the related art, for a switch-on spark suppression; this diode 23 may alternatively be replaced with diode 21. A spark gap 6 relative to ground 14, via which ignition current $i_2$ is to ignite the combustible gas mixture, is provided in a loop with secondary coil 9 and diode 23. After an ignition has taken place, a usually fluctuating spark voltage $U_{brenn}$ is applied at spark gap 6. According to the present invention, a step-up chopper 7 is provided between electrical energy source 5 and secondary side 4 of step-up transformer 2. Furthermore, an inductivity 15 is connected with a capacity 10 via a switch 22 and a diode 16. One end of capacity 10 is connected to secondary coil 9 and its other end is connected to electrical ground 14. The inductivity serves as an energy store in this case for maintaining a current flow. Diode 16 is conductively oriented in the direction of capacity 10. A shunt 19 as a current-measuring means or a voltage-measuring means is provided between capacity 10 and secondary coil 9, its measuring signal being supplied to switch 22 as well as to switch 27. In this way switches 22, 27 are designed to react to a defined range of current intensity $i_2$ through secondary coil 9. The terminal of switch 22 facing diode 16 is able to be connected to electrical ground 14 via a further switch 27. To protect capacity 10, a Zener diode 21 is switched in parallel with capacity 10 in the reverse direction. In addition, switch signals 28, 29 are sketched through which switches 22, 27 are able to be controlled. While switch signal 28 represents a switch-on and "remain closed" for an entire ignition cycle, switch signal 29 sketches a simultaneous alternating signal between "closed" and "open." With a closed switch 22, inductivity 15 is supplied with a current via electrical energy source 5, the current flowing directly to electrical ground 14 when switches 22, 27 are closed. Given an open switch 27, the current is forwarded to capacitor 10 via diode 16. The voltage that comes about in response to the current into capacitor 10 is added to the voltage dropping over secondary coil 9 of step-up transformer 2, whereby the arc at spark gap 6 is supported. However, capacitor 10 is discharged in the process so that by closing switch 27, energy is able to be brought into the magnetic field of inductivity 15 in order to charge this energy back to capacitor 10 in a renewed opening of switch 27. As can be seen, actuation 31 of switch 30 provided in primary side 3 is kept clearly shorter than is the case for switches 22 and 27. Since switch 22 does not assume any essential function for the processes according to the present invention but simply switches the circuit on or off, it is optional and can therefore also be omitted. If an instant at which spark voltage $U_{brenn}$ is essentially independent of the gas mixture inside the combustion chamber is selected for the generation of the spark at spark gap 6 according to the present invention, electrical parameters at spark gap 6 are able to be evaluated in evaluation unit 36 of the ignition system, e.g., via shunt 19, in order to draw conclusions with regard to the electrode gap. Through output-side capacity 10, step-up chopper 7 provides an electrical power at P0 adapted in response to the aforementioned evaluation in order to bring the duration of the ignition spark as well as spark current $i_2$ into value ranges that are suitable for a reliable mixture ignition.

Figure 2:
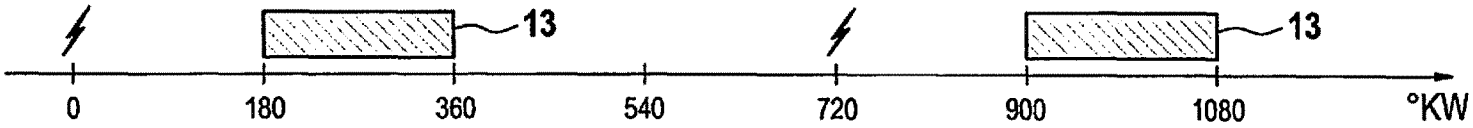
FIG. 2 illustrates crank-angle ranges in which the ignition spark is advantageously able to be generated according to an example embodiment of the present invention.

FIG. 2 shows suitable ranges, relative to the crank angle, for generating the spark proposed according to an example embodiment. While the sparks illustrated for the mixture ignition at a crank angle of 0° and a crank angle of 720° are used for igniting the mixture, marked crank angle ranges 13 between 180° and 360° as well as between 900° and 1080° are suitable for generating a spark at the spark gap without igniting an ignitable mixture in the combustion chamber. In particular, relatively low pressures and turbulences prevail in these crank angle ranges so that relatively little energy is required to generate the spark.

Figure 3:
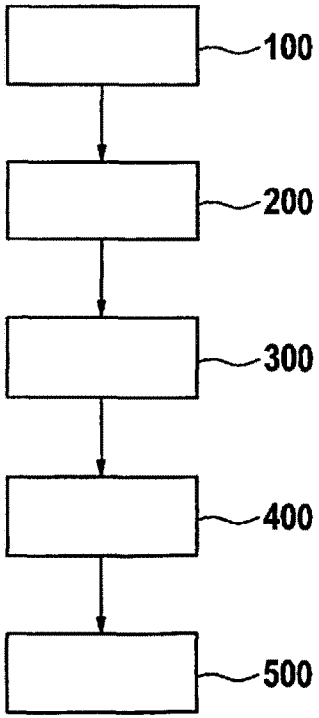
FIG. 3 a flow diagram that illustrates steps of an exemplary embodiment of a method according to an example embodiment of the present invention.

FIG. 3 shows steps of an exemplary embodiment of a method according to the present invention. In step 100, a spark at the spark gap is generated in an operating state without ignition of an ignitable mixture in the combustion chamber. Preferably, the spark is therefore generated in an exhaust working stroke. In step 200, a characteristic function that represents the spark current is ascertained over the time and compared with a predefined reference in step 300. In the process, the necessity for increasing the spark current in step 400 is determined due to a greater electrode gap as a result of erosion; this is accomplished by increasing the output power of a step-up chopper used for maintaining the ignition spark. In order to document the advanced state of erosion of the electrodes despite a maintained operational readiness of the ignition system according to the present invention, in step 500 an entry in a fault memory is made, which suggests an exchange of the spark plugs during the next service appointment.

According to the present invention, the forwarding of the wear information to the onboard diagnosis (OBD), for example, may be used for a need-based exchange of the spark plugs and otherwise for an adaptation of the electrical parameters of the ignition system to the current wear state. In addition, the present invention makes it possible to reduce the provision of additional electrical energy that is always required according to the related art for ensuring a proper ignition process. The analysis according to the present invention makes it possible to reduce these safety reserves and thus to increase the efficiency of the ignition system. Furthermore, a need-based supply of electrical energy reduces the spark erosion at the electrodes. The thermal and electrical loading of the components of the ignition system are able to be reduced as well.

In real applications, for example, the method according to the present invention is able to be carried out every 1000 km of driving distance for vehicles equipped with the ignition system according to the present invention. For internal combustion engines used in a stationary manner, an execution every 5 to 10 hours of service, for example, may be provided. Of decisive importance is to ensure that the conditions in the combustion chamber are constant in each case. In other words, the temperature, pressure, and the flow rate must be known or predictable, at least within narrow limits. A suitable operating state is an idling state with a predefined oil/cooling water temperature, for instance.

Notwithstanding the fact that the aspects of the present invention and the advantageous specific embodiments have been described in detail on the basis of the exemplary embodiments in conjunction with the figures of the drawing, one skilled in the art will derive modifications and combinations of features in the exemplary embodiments illustrated without departing from the scope of the present invention, whose protective scope is defined by the attached claims.

What is claimed is:

1. A method for operating an ignition system for generating a spark at a spark gap in a combustion chamber of an internal combustion engine with an externally supplied ignition, the method comprising:

generating the spark at the spark gap in an operating state without ignition of an ignitable mixture in the combustion chamber;

ascertaining, by an evaluation unit, a parameter or characteristic function representing at least one of the spark current, the spark voltage, and the spark duration;

comparing, by the evaluation unit, the parameter or the characteristic function to a reference;

adapting, by the evaluation unit, at least one of an amount and a duration of voltage at the spark gap for at least one of generating and maintaining a further ignition spark for ignition of the mixture as a function of a difference between the parameter or the characteristic function and the reference, determined as a result of the comparison; and generating and maintaining the further ignition spark at the spark gap for the ignition of the mixture, using the adapted voltage;

wherein the generation of the further ignition spark is performed with a primary voltage generator, and wherein the further ignition spark is maintained using a step-up chopper.

2. The method of claim 1, wherein the reference is a first threshold value which is specified on the basis of the spark gap at an initial operation of the ignition system and while taking a maximally permitted wear into account.

3. The method of claim 1, wherein the voltage is adapted by increasing a voltage availability through the primary voltage generator or through the step-up chopper.

4. The method of claim 3, wherein:

the reference is a first threshold value which is specified on the basis of the spark gap at an initial operation of the ignition system and while taking a maximally permitted wear into account; and the voltage availability at electrodes that are at the spark gap is increased in a step-by-step manner until a predefined second threshold value has been reached.

5. The method of claim 4, wherein, after the predefined second threshold value has been exceeded, a fault signal is output which indicates that an exchange of the electrodes is required.

6. The method of claim 1, wherein the comparing includes evaluating a profile of the characteristic function over the time.

7. The method of claim 1, wherein the spark that is generated at the spark gap in the operating state without the ignition is generated at an instant without a presence of an ignitable mixture.

8. The method of claim 1, wherein the spark that is generated at the spark gap in the operating state without the ignition is generated at an instant that is without a presence of an ignitable mixture and that features low turbulence in the combustion chamber.

9. The method of claim 1, wherein the spark that is generated at the spark gap in the operating state without the ignition is generated in an exhaust working stroke of the internal combustion engine.

10. The method of claim 1, wherein the spark that is generated at the spark gap in the operating state without the ignition is generated in an exhaust working stroke with closed intake valves of the internal combustion engine.

11. The method of claim 1, wherein the further ignition spark is maintained using a constant electrical power of a step-up chopper.

12. The method of claim 1, wherein the parameter is ascertained in an essentially stationary state.

13. The method of claim 1, wherein an electrical voltage is used as reference, the method further comprising:

ascertaining whether an overshooting condition is satisfied by determining whether the spark voltage exceeds the reference; and at least one of increasing a voltage availability for spark generation and increasing an output power of a primary voltage generator or a step-up chopper if the overshooting condition is satisfied.

14. The method of claim 13, wherein the increasing of the output power of the step-up chopper is performed, the increasing being by increasing at least one of a spark current and an output current of the step-up chopper.

15. The method of claim 1, wherein an electrical current is used as reference, the method further comprising:

ascertaining whether an undershooting condition is satisfied by determining whether the spark current or an output current of a step-up chopper undershoots the reference; and at least one of increasing a voltage availability for spark generation and increasing an output power of a primary voltage generator or a step-up chopper if the undershooting condition is satisfied.

16. The method of claim 15, wherein the increasing of the output power of the step-up chopper is performed, the increasing being by increasing at least one of a spark current and an output current of the step-up chopper.

17. The method as recited in claim 1, wherein the evaluation unit includes one of: (i) a programmable processor, (ii) a programmable controller, (iii) an ASIC, or (iv) a Field Programmable Gate Array.

18. The method as recited in claim 1, the adapting includes increasing the at least one of the amount and the duration of the voltage at the spark gap using a step-up chopper.

19. An ignition system for an internal combustion engine with externally provided ignition, the ignition system comprising:

a spark gap;

a primary voltage generator; and an evaluation unit, wherein the evaluation unit is configured to:

use the primary voltage generator to generate a spark at the spark gap in an operating state without ignition of an ignitable mixture in the combustion chamber;

ascertain a parameter or characteristic function representing at least one of the spark current, the spark voltage, and the spark duration;

compare the parameter or the characteristic function to a reference;

adapt at least one of an amount and a duration of voltage at the spark gap for at least one of generating and maintaining a further ignition spark for ignition of the mixture as a function of a difference between the parameter or the characteristic function and the reference, determined as a result of the comparison; and generate and maintain the further ignition spark at the spark gap for the ignition of the mixture, using the adapted voltage;

wherein the generation of the further ignition spark is performed with a primary voltage generator, and wherein the further ignition spark is maintained using a step-up chopper.

20. The ignition system of claim 19, furthermore comprising:

a step-up chopper whose output lies in an electrical loop with the spark gap and that is configured to inject a predefined electrical quantity in order to maintain the further ignition spark.

21. The ignition system of claim 20, wherein the predefined electrical quantity is at least one of an output current, an output voltage, and an output power into the spark gap.

22. The ignition system of claim 19, wherein the evaluation unit is configured to adapt an operating mode of the step-up chopper or a primary voltage generator in response to the result of the comparison.

23. The ignition system as recited in claim 19, wherein the evaluation unit includes one of: (i) a programmable processor, (ii) a programmable controller, (iii) an ASIC, or (iv) a Field Programmable Gate Array.

24. The ignition system as recited in claim 19, wherein the primary voltage generator provides at least one of an increased voltage, an increased current, and an increased power, to electrodes at the spark gap to generate the further ignition spark at the spark gap.

25. A method for operating an ignition system for generating a spark at a spark gap in a combustion chamber of an internal combustion engine having externally supplied ignition, the method comprising:

generating the spark at the spark gap using a primary voltage generator;

ascertaining a parameter;

comparing the parameter to a reference;

adapting an energy, as a function of a difference between the parameter and the reference, for at least one of: (i) a voltage buildup for the spark generation, and (ii) maintaining an ignition spark for ignition of an ignitable mixture in the combustion chamber, as a function of a difference between the parameter and the reference, wherein the adapting is for a future ignition process;

wherein, in the generating step, the spark at the spark gap is generated in an operating state without ignition of the ignitable mixture in the combustion chamber and is maintained by a step-up chopper so that the parameter correlates with an electrode state or electrode gap at the spark gap;

wherein, in the ascertaining step, at least one of a spark current and the spark voltage is ascertained as the parameter; and wherein a value of the reference is a first threshold value which is specified based on the electrode gap at an initial operation of the ignition system and while taking a maximally permitted wear into account;

and wherein the method further comprises using the adapted energy in the future ignition process to at least one of generate and maintain a further ignition spark at the spark gap for the ignition of the mixture.

* * * * *